United States Patent [19]

Sandrin

[11] Patent Number: 5,054,473

[45] Date of Patent: Oct. 8, 1991

[54] HYDROMASSAGE CARPET

[75] Inventor: Glannino Sandrin, Pordenone, Italy

[73] Assignee: Albatros System S.p.A., Pordenone, Italy

[21] Appl. No.: 527,735

[22] Filed: May 23, 1990

[30] Foreign Application Priority Data

May 23, 1989 [IT] Italy ..... 45731 A/89

[51] Int. Cl.[5] ..... A61H 9/00

[52] U.S. Cl. ..... 128/66; 128/65; 128/38; 4/451; 4/752; 4/453

[58] Field of Search ..... 128/65, 66; 4/451, 452, 4/453

[56] References Cited

U.S. PATENT DOCUMENTS

| | | | |
|---|---|---|---|
| 4,122,846 | 10/1978 | Baumann | 128/66 |
| 4,409,693 | 10/1983 | Baumann | 4/543 |
| 4,417,568 | 11/1983 | Nozawa et al. | 128/66 X |
| 4,962,759 | 10/1990 | Stern et al. | 4/543 X |

*Primary Examiner*—Robert A. Hafer
*Assistant Examiner*—Brian E. Hanlon
*Attorney, Agent, or Firm*—Wenderoth, Lind & Ponack

[57] ABSTRACT

A hydromassage carpet is formed by an envelope of two sheets of suitable soft and flexible material, which are joined together with a peripheral weld and further welds effected on the inner part thereof defining two distinct ducts. These ducts include a first sealed duct to be filled with a suitable fluid so as to form a practical mattress, and a second duct connected through a feeding pipe to a compressed air generator and provided at its upper part with holes. The compressed air generates in the bath the desired hydromassage effect by passing through the holes. Inwardly of the peripheral weld are provided several circumferential toes at whose centers relevant central welds extend over an amount sufficient to form a plurality of toroidal elements. The lower parts of these elements, when resting on the bottom of the tub, define cavities similar to those of suction cups and therefore, carry out the same function thereof. Adjacent circumferential toes terminate at certain portions which are directly connected together by further suitable toes, so as to form the first duct at the inside therefore and the second duct to the outside thereof.

2 Claims, 1 Drawing Sheet

HYDROMASSAGE CARPET

BACKGROUND OF THE INVENTION

The present invention concerns a new kind of hydromassage carpet, fabricated in a per se known manner to form an envelope from two thin sheets of a suitable flexible material. The sheets are welded together so as to form a soft mattress having a preferably rectangular shape. Due to the particular shape of internal welding zones, a plurality of toroidal elements are provided in which a part thereof which is to rest on the bottom of the bath tub serves as an effective sucker to removably fix the carpet to the tub.

Hygienic-sanitary treatments referred to as hydromassage may be obtained by various known means, including an arrangement of hollow elements provided with a plurality of holes in its upper part, and which arrangement is to be disposed on the bottom of a common bath tub, a small swimming pool or the like. The hollow elements are fed with compressed air and generate in the water contained in the tub a plurality of gaseous bubbles which give rise to the hydromassage effect while traveling upward. Among the different known arrangements, a hydromassage carpet described in patent application No. 45726 A/89 filed in Italy by the present inventor has remarkable advantages with respect to its construction, application and use.

The hydromassage carpet referred to is constituted by a suitably sized envelope preferably having a rectangular shape, which is positionable on the bottom of a bath tub or the like and is obtained by welding together two sheets of an adequate flexible material so as to form an effective mattress in which two independent ducts are provided. These ducts include a first duct which is sealed and a second duct provided at its part which faces upward during use with a suitable number of holes adequately distributed therealong and connected through a feeding pipe to a compressed air generator. Thus, when fed with compressed air, the second duct generates a plurality of gaseous bubbles traveling upward through the water contained in the tub, thereby generating the desired hydromassage effect. However, this carpet requires suction cups to secure it to the tub, which cups are costly to manufacture and occupy a large space.

SUMMARY OF THE INVENTION

The hydromassage carpet of the present invention, on the other hand, is characterized in that a first duct is defined by a plurality of circumferential toes. At the center of each of the toes a further central weld is effected which extends a sufficient circular amount so as to in turn define a plurality of hollow annular spaces which, when filled with a suitable fluid, provide a plurality of toroidal elements. The lower part of each element situated between the zone of contact on the support surface of the bottom of the tub, on which the hydromassage carpet rests, and the associated central weld defines a cavity fully capable of functioning as a suction cup. Thus, the toroidal elements form a removable connection of the hydromassage carpet to the tub, without the need of further means.

BRIEF DESCRIPTION OF THE DRAWINGS

The features and advantages of the hydromassage carpet of the present invention will be better understood from the description hereinafter, of a non-limitative example but preferred embodiment thereof, made with reference to the attached drawings wherein.

DETAILED DESCRIPTION OF THE PREFERRED EMBODIMENTS

Figure 1:
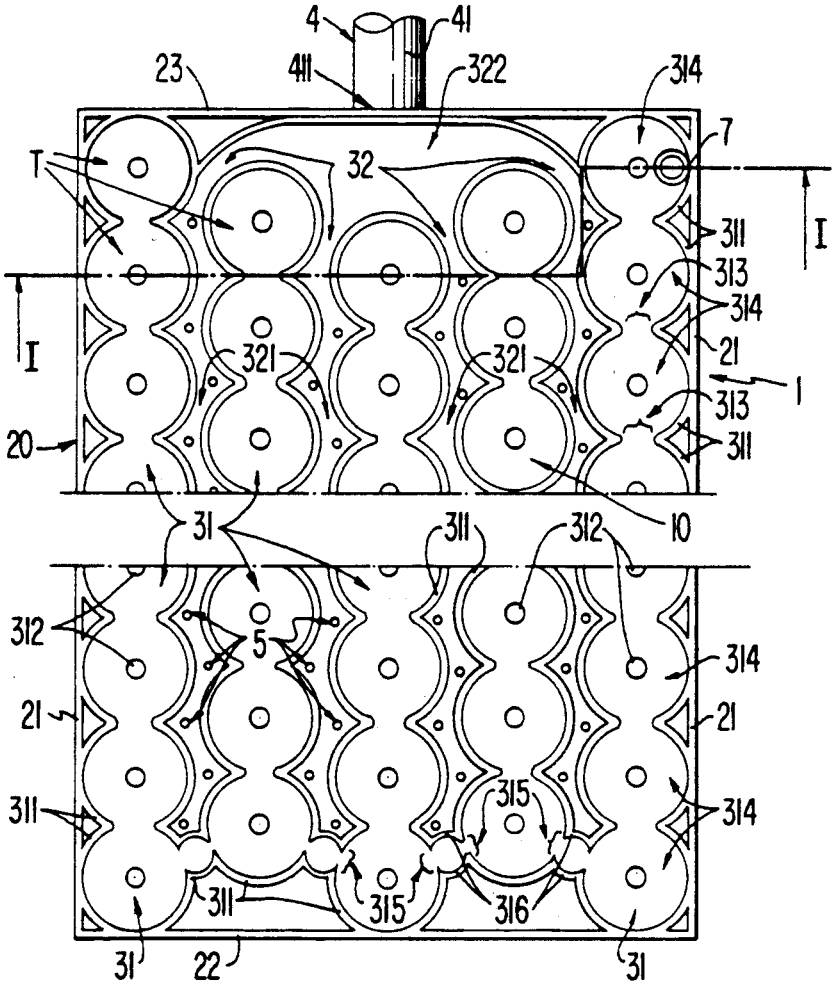
FIG. 1 is a plan view of a hydromassage carpet according to the present invention.

With reference to the figures in which like items are marked with the same reference numerals, the carpet 1 is constituted by an envelope 10 obtained by joining together two sheets of suitable soft and flexible material, namely an upper sheet 11 and a lower sheet 12, by known means so as to obtain a hollow structure fully similar to a common pneumatic mattress. More precisely, and referring particularly to FIG. 1, carpet 1 is obtained by welding together two sheets 11 and 12 each of which has a substantially rectangular form. A peripheral weld 20 is effected along the entire perimeter thereof so as to form two welded side portions 21, a welded lower portion 22, and a welded upper portion 23 to the center of which the end 411 of a flat flexible pipe 41 is welded. Pipe 41 constitutes a feeding pipe 4 whose function will be hereinafter described.

A further weld is effected between the sheets inwardly of the peripheral weld 20 so as to define two distinct ducts, a first sealed duct 31 and a second duct 32.

Such ducts 31 and 32 are defined by a plurality of circumferential toes 311. And, central welds 312 are effected centrally between the pairs of toes 311 to form annular spaces 314 within ducts 31.

The circumferential toes 311 are aligned in groups, adequately spaced from each other, so as to define respective branches of said first (31) and second duct (32) which, in the preferred embodiment, extend parallel to the sides of the envelope 10.

Further, said circumferential toes 311 are substantially tangent to each other along each branch, and terminate at tangency zones so that appropriate openings 313 are formed by which the annular spaces 314 are interconnected with each other.

Finally, the circumferential toes at lower ends of adjacent branches also terminate to form openings 315, which are interconnected by toes 316 so that the various branches are interconnected.

It is also to be noted that various others of the circumferential toes constituting the branches may be interconnected together in the same manner described above.

As clearly shown in FIG. 1, the rows of circumferential toes 311 forming the various above-mentioned branches are so arranged in the transverse direction of the carpet 1 that the centers of the circumferential toes 311 of a row are aligned with the tangency zones of the adjacent row, respectively.

Furthermore, the circumferential toes of each row are adequately spaced from those of the adjacent row or rows, thus forming further hollow spaces 321 constituting the respective branches of the second duct 32 which, on the upper end of the carpet 1, are interconnected by a hollow space 322 providing an effective manifold. The hollow space is, in turn, centrally connected to the feeding pipe 4.

A plurality of holes 5 are provided on that portion of the carpet which overlies hollow spaces 321 when the carpet is in use. And finally, a connection 7 of a known kind per se is provided in communication with a hollow space 313 of said first duct 31, preferably thereabove, for permitting said first duct 31 to be filled with a suitable fluid or to be emptied. And, as shown in FIG. 1, connection 7 is provided on the upper end of a side branch of the first duct 31.

Figure 2:
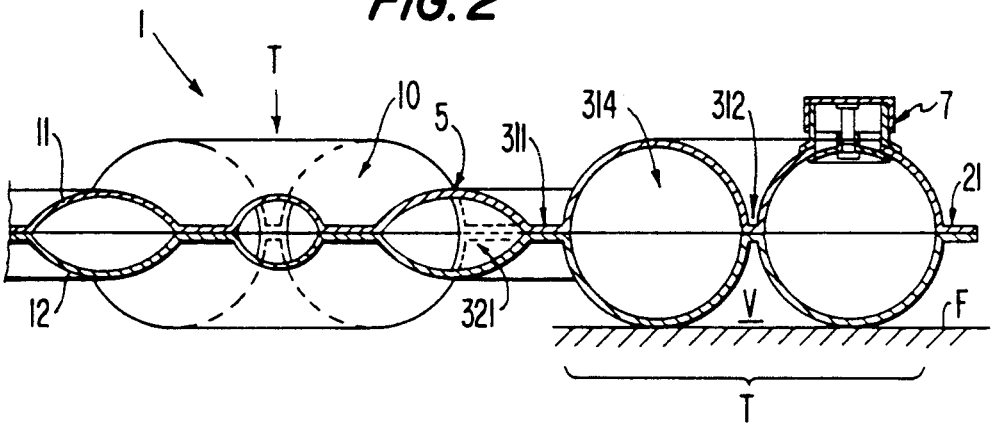
FIG. 2 is an enlarged sectional view taken along line I—I of FIG. 1.

It is to be noted that the circumferential toes 311 and the respective central welds 312 define a correspondent number of the hollow annular spaces 314 which, when said first duct is filled with a fluid, as particularly shown in FIG. 2, constitute toroidal elements T which in turn clearly define cavities V in the form of an effective suction cup. The effective suction cup is thus located between the support zone at the bottom F of the basic on which the carpet is applied and the associated central weld 312.

It follows that, when the first duct 31 is filled with fluid as explained above, by laying the carpet on the bottom of the basin the various toroidal elements T fix the carpet removably thereto owing to their functioning effectively as suction cups.

When the carpet is thus disposed for use, it is sufficient to connect it through the feeding pipe 4 to a per se known compressed air generator.

Then, the compressed air (for example, ozonized air and/or air to which other fluids have been added) is fed through the manifold 322 to the hollow spaces 321 forming the branches of said second duct 32 and leave the carpet through the holes 5 thereby generating the desired hydromassage effect.

It is to be noted that the portions of the carpet forming the hollow spaces 321 of the second duct 32 are disposed at levels below those which form the hollow spaces 314 of said toroidal elements T, so that the user's body resting on the upper part of the carpet doesn't block the holes 5.

Finally, the welds forming the toroidal elements T and annular spaces 314 may be effected differently to provide elements having different outlines.

In conclusion, it is therefore evident that the hydromassage carpet 1 of the present invention is provided with respective toroidal elements T serving as effective suction cups owing to the particular configure of toes 311 and welds (toes) 312. Thus, the provision of separate suction cups is unnecessary. Therefore, besides having a considerably simple structure, the present invention may be fabricated at a remarkably low manufacturing cost.

Moreover, the so-obtained carpet, which can be rolled up on itself, occupies a relatively smaller space with respect to the hydromassage carpet already described in patent application No. 45726 A/89, since it does not include the suction cups which, during the rolling up thereof, clearly occupy a relevant space.

It is to be well understood that different variants of the carpet of the present invention may be carried out without departing from the scope of what is hereinafter claimed, and therefore all such variants are seen to be included within the true spirit and scope of the present invention.

I claim:

1. A hydromassage carpet for use on the bottom of a bath tub or the like, said carpet comprising: two sheets of flexible material secured to one another along the respective peripheries thereof so as to define an envelope therebetween; circumferential toes at which portions of said sheets inwardly of the peripheries thereof are secured to one another, said circumferential toes partitioning said envelope into a first duct and a second duct sealed from one another, said first duct defined between opposing pairs of said circumferential toes, said second duct defined on opposite sides of said circumferential toes from said first duct, and one of said sheets having a plurality of holes therethrough at locations over said second duct and distributed therealong whereby said holes communicate with said second duct; a feeding pipe connected to said sheets in communication with said second duct; and central toes at which portions of said sheets located centrally between said opposing pairs of said circumferential toes are secured to one another so that a respective hollow annular space is formed in said first duct between each opposing pair of circumferential toes and the central toe located centrally thereof, the other of said sheets defining a plurality of cavities therein open at a surface of the carpet when said first duct is expanded under pressure, and each of said cavities having a generally V-shaped cross section in the form of a suction cup, the vertex of which terminates at a respective said central toe.

2. A hydromassage carpet as claimed in claim 1, wherein each of said sheets is rectangular such that the carpet is rectangular.

* * * * *